United States Patent [19]

Kurvers et al.

[11] Patent Number: 4,646,450

[45] Date of Patent: Mar. 3, 1987

[54] HANDLING DEVICE FOR SUCTION HEAD EQUIPMENT

[75] Inventors: Hedwigus A. M. H. Kurvers, Born-Buchten; Adrianus Bras, Dordrecht, both of Netherlands

[73] Assignee: IHC Holland N.V., Papendrecht, Netherlands

[21] Appl. No.: 777,039

[22] Filed: Sep. 17, 1985

[30] Foreign Application Priority Data

Sep. 20, 1984 [NL] Netherlands ..... 8402887

[51] Int. Cl.[4] ..... E02F 3/92

[52] U.S. Cl. ..... 37/72

[58] Field of Search ..... 408/35; 29/568; 37/58, 37/72

[56] References Cited

U.S. PATENT DOCUMENTS

| | | | |
|---|---|---|---|
| 1,840,606 | 1/1932 | Scheffauer | 37/58 |
| 4,282,661 | 8/1981 | Nagelkerke | 37/58 |
| 4,535,527 | 8/1985 | Fischer et al. | 29/568 |

*Primary Examiner*—Clifford D. Crowder

*Attorney, Agent, or Firm*—Young & Thompson

[57] ABSTRACT

The invention relates to the rapid exchange of a detachably fastened part such as the suction head (3) of the suction pipe (2) of a hopper suction dredge (1) or a part of the suction head by a rapid-action coupling (7,8) and by a device (10,12,13,14,15) on deck (1) which can grip the part (3) while it is still fastened, can remove it after uncoupling and move the other part (16) towards the coupling (7,8) which device preferably comprises a number of arms (12,13) in fixed position relative to one another and rotatable about a horizontal axis (11) each arm (12,13) having a device (14,15) for carrying and releasing a suction head (3,16).

5 Claims, 6 Drawing Figures

HANDLING DEVICE FOR SUCTION HEAD EQUIPMENT

The invention relates to a hopper suction dredge provided with a suction pipe which can be brought inboard or outboard with the aid of hoisting means and which at its bottom end is provided with a detachably fastened part.

A hopper suction dredge of this kind is widely known, particularly in the form of a towed hopper dredge, the exchangeable part being a suction head.

For different types of beds to be dredged it is desirable, in order to achieve optimum dredging results, always to use a suction head, particularly a towed suction head, adapted to the type of bed to be dredged. Thus, for the dredging of a sand stratum a different head is required from that used for dredging a gravel stratum, while in turn a quite different head is needed for dredging a layer of mud, apart from the fact that each of these types of stratum may be of many different kinds. Sand may be loose sand, or it may be very compact.

Hitherto a suction head had to be replaced in calm water and took considerable time. In order to make the exchange it is not only necessary to undo a large number of bolts and, after replacement of the head, to refit the bolts, but it is also necessary that the ship should not move excessively. With a rolling and pitching ship these operations are practically or completely impossible because of the uncontrollable freedom of movement of the loads on the hoisting means situated on board. This known exchange of the suction head is accompanied by a loss of production. If during the course of dredging operations the composition of the material being dredged should change, it is difficult to fit a different suction head, and the dredging is therefore often continued with a less suitable suction head.

Similar considerations apply to cases where a part of the suction head, such as a sight, has to be replaced.

The invention seeks to provide a solution to this problem.

According to the invention this solution consists in principle in that the aforesaid part is fastened by means of a rapid-action coupling and that on deck a device is provided which can grip the part while it is still fastened, can move it over a fixed path after uncoupling, and can correspondingly replace it with another part.

The fastening between the suction head and the suction pipe, or for example between the sight and the suction head, is therefore now a connection which can quickly be made or released, while for the exchange use can be made of a device which grips the part which is to be removed, for example the suction head, and moves it away over a path which prevents undesirable movements of the load, and also moves to the suction pipe or suction head a part which is then to be fitted, such as the suction head, after which the rapid-action coupling can be reconnected.

Although the invention is of particular interest for the replacement of the relatively heavy suction head, the invention also extends to the replacement of parts of the suction head itself, such as cutting means, a sight, or other accessories.

This exchanging device may be of different types. It is thus conceivable to use a carriage which is adapted to support a suction head requiring to be replaced and which on its sideways displacement brings the other suction head, which is also disposed on it, in front of the end of the suction pipe. It is also conceivable to make use of a rotating device which carries one or more suction heads and which grips the the suction head which is to be removed and, as it is moved away, brings the other suction head to the suction pipe.

According to the invention a device of the last type preferably consists of a number of sets of arms which are rotatable about a horizontal axis and which are situated in a fixed position relative to one another and can be turned conjointly, each of these arms being provided at its end with a device for holding fast, carrying and releasing a suction head. A device of this kind takes up little space on deck and can therefore be installed on existing ships. Owing to the fact that on the changing of a suction head a rotation of the removed suction head is made over a determined angle, it is in addition brought into a position in which repair work can more easily be done on the head. The underside of the removed suction head is turned upwards by the rotation, and is therefore more readily accessible.

The device can obviously be so constructed that a part of the path of movement of the arms is located under the deck. However, this requires modifications to the ship, which are undesirable and not always possible. It is in fact preferable for the entire device to be situated on deck, and according to the invention it is desirable for the shaft carrying the arms to be mounted in a yoke which is pivotable through a determined angle. It is in fact then possible, in combination with a slight rotation, for the entire device to be brought to a greater distance from the mounted suction head, so that with the aid of the derricks situated on deck the suction head can more easily be raised and moved outboard. In addition, this pivoting movement is necessary in order to move a firmly gripped uncoupled suction head along the end of the suction pipe, and is also necessary in order to complete the uncoupling or effect the recoupling.

The invention will now be more fully explained with the aid of the drawings.

Figure 1:
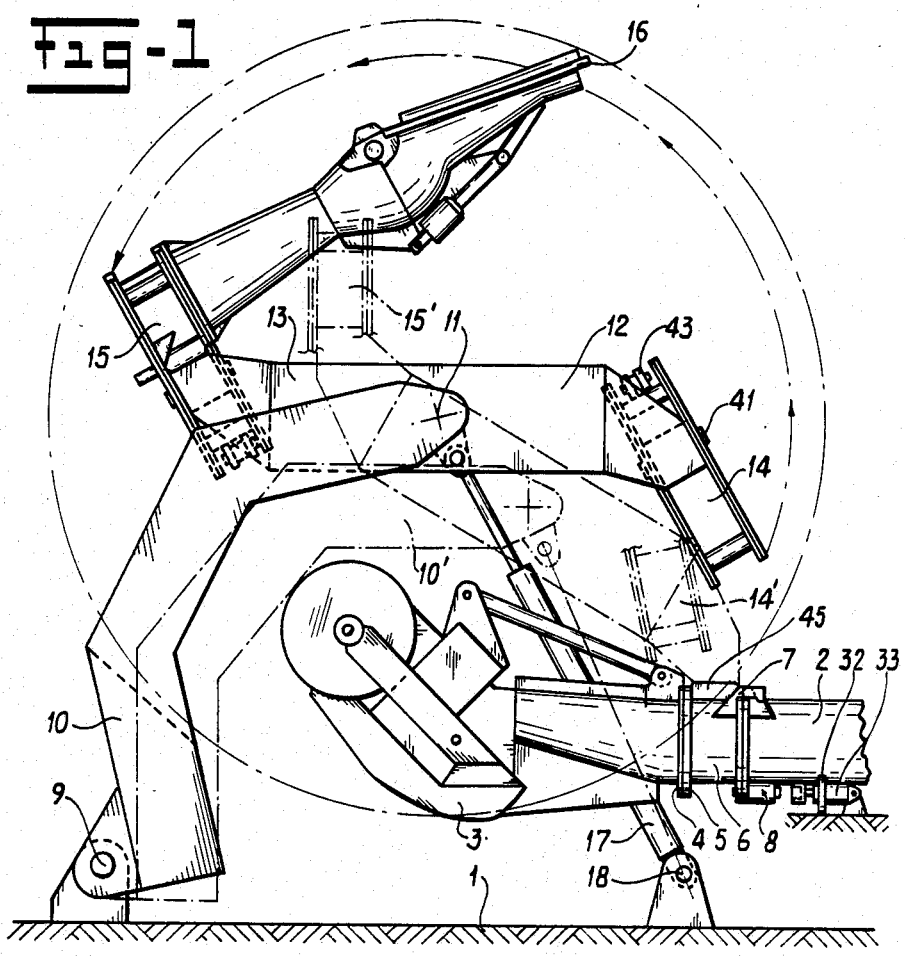
FIG. 1 shows a diagrammatical side view of a preferred form of construction of the changing device according to the invention.
Figure 2:
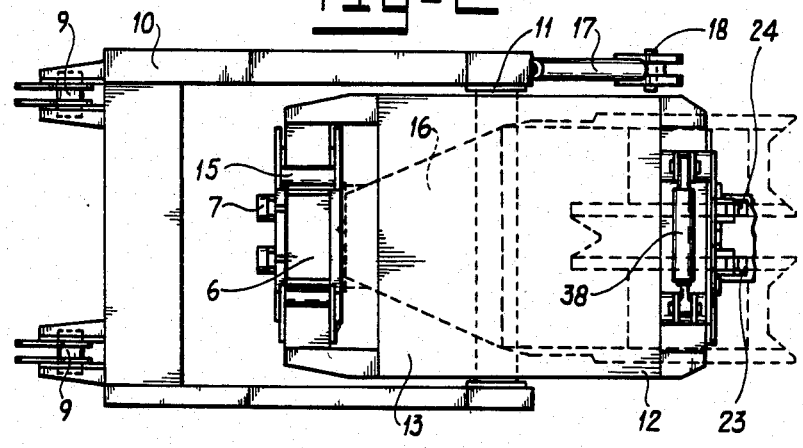
FIG. 2 is a top plan view corresponding to FIG. 1 but viewed slightly obliquely from the left of FIG. 1.

The device shown in FIGS. 1 and 2 is situated on the side of the deck of a hopper suction dredge, this deck being designated 1.

2 designates the end of a suction pipe which is hoisted on board with the aid of hoisting gear known per se and which rests on supports known per se.

Figure 4:
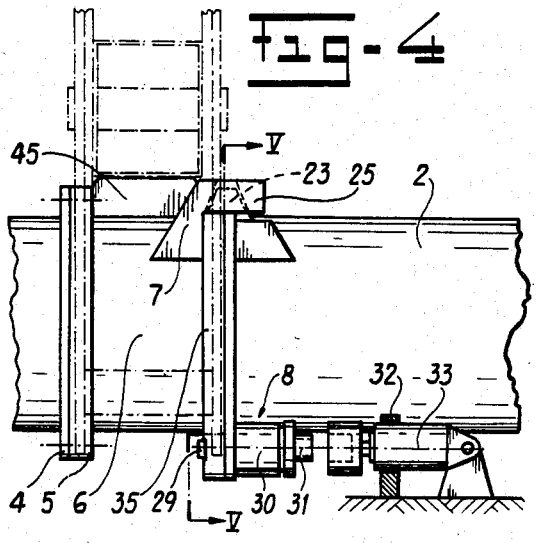
FIG. 4 is a side view of a possible rapid-action coupling.
Figure 5:
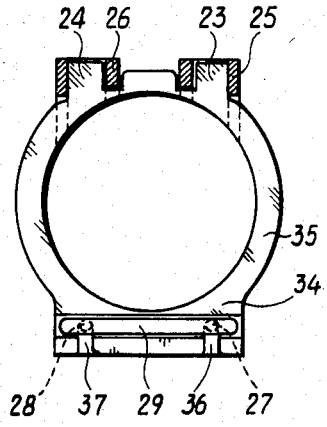
FIG. 5 is a section on the Line V—V in FIG. 4.

On this suction pipe 2 is mounted a mud section head 3, which is fastened by a flange 4 to a flange 5 of a rapid-action coupling part 6 which is fastened to the suction pipe by means of the rapid-action couplings 7 and 8 shown in FIGS. 4 and 5.

A yoke 10 is fastened at 9 on the deck for pivoting about a horizontal axis and carries a horizontal shaft 11 on which are fastened the arms 12 and 13 extending in opposite directions, each arm being provided with the clamp 14 or 15 respectively, shown in FIG. 1. In the position shown in solid lines in FIG. 1, the clamp 15 holds a towing suction head 16 for dredging sand.

The clamp 14 is at a distance from the coupling part 6 of the mud suction head 3.

The yoke 10 is coupled to the deck by means of a hydraulic cylinder 17, at 18.

With the aid of this cylinder 17, the yoke 10 can be brought into the position 10' shown in dot and dash lines.

Figure 6:
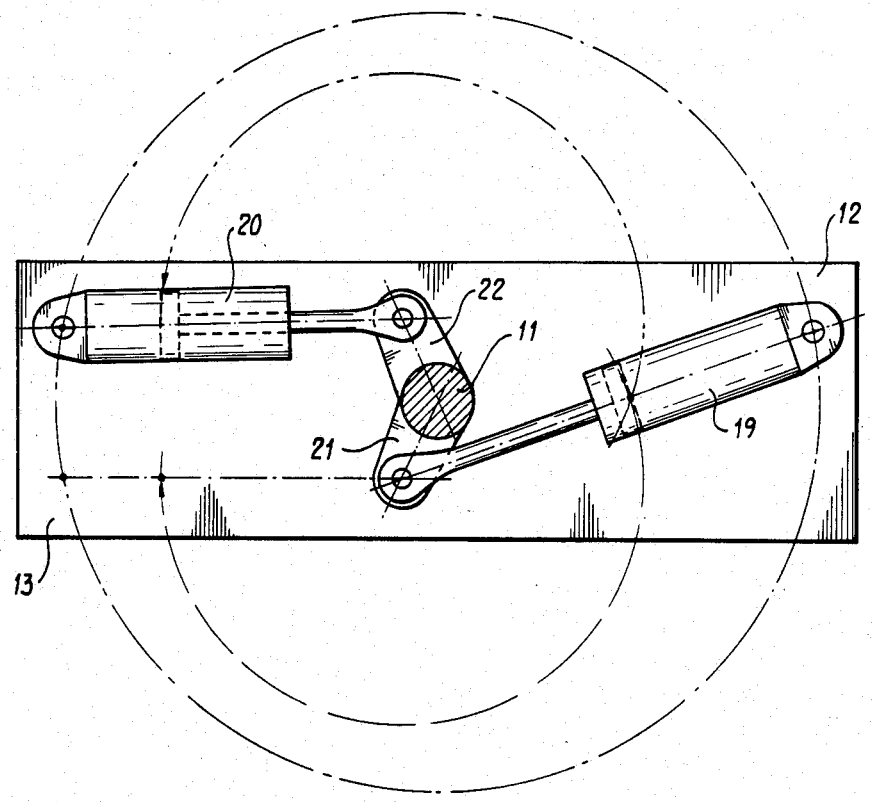
FIG. 6 is a diagrammatical side view of the device for turning the changing device shown in FIG. 1.

FIG. 6 shows a pair of cylinders 19 and 20 respectively which by means of their drive rods act on arms 21 and 22 respectively on the shaft 11. With the aid of these cylinders an angular rotation can be imparted to the arms 12, 13.

When a suction head has to be changed, a slight angular rotation, in the clockwise direction in FIG. 1, is first given to the arms 12 and 13 with the aid of the mechanism shown in FIG. 6. In FIG. 1 this position is shown only for the clamp 14, namely at 14'. With the aid of the cylinder 17 the yoke is thereupon turned to the right into the position 10' shown in dot and dash lines, while the clamp 14 turns to a position above the coupling part 6 and the clamp 15 assumes the position 15' shown in dot and dash lines. The head 16 is here omitted for the sake of clarity.

The rapid-action coupling consists of wedge-shaped bosses 23, 24 on the top face of the end of the suction pipe 2, eyes 25, 26 on the rapid-action coupling 6 being adapted to engage over said bosses, and, on the bottom face, a pair of pins 27, 28 which are displaceable parallel to the centre line of the suction pipe and which can be coupled together by means of a cross strap 29. These pins are pulled to the right in FIG. 4 by springs (not shown but disposed in casings, such as the casing 30) and have a part 31 projecting to the outside.

On the support 32 are disposed hydraulic cylinders 33, which on a displacement of their piston rods to the left act on the ends 31 of the pins and move the latter to the left, so that the bottom edge 34 of the flange 35 is released from the coupling part 6 and by means of the slots 36, 37 this flange can be removed from or placed over the pins.

Thus, when the clamp 14 is situated above the head part 6 and is brought into the closed position, and after the bottom rapid-action coupling has been released with the aid of the cylinders 33, the yoke 10 can be turned back with the aid of the cylinder 17, whereupon the mud suction head 3 is freed from the suction pipe 2.

When the arms 12 and 13 are then turned 180° with the aid of the mechanism shown in FIG. 6, the head 16 will take the place of the head 3 and can consequently be connected to the suction pipe 2 when the yoke 10 is moved back to the right, the eyes 25, 26 falling automatically over the bosses 23, 24. When the cylinders 33 are then released, the springs will ensure that the new coupling part 6 is locked relative to the suction pipe 2.

The yoke 10 then turns back and a slight angular rotation is given to the arms into the position shown in solid lines, whereupon the suction pipe with the head fastened on it can be lifted overboard.

In FIG. 2 the towing head 16 is shown in broken lines. FIG. 2 is a top plan view which should not be viewed vertically from above, but slightly obliquely from the left, perpendicularly to the centre line through the towing head 16.

Figure 3:
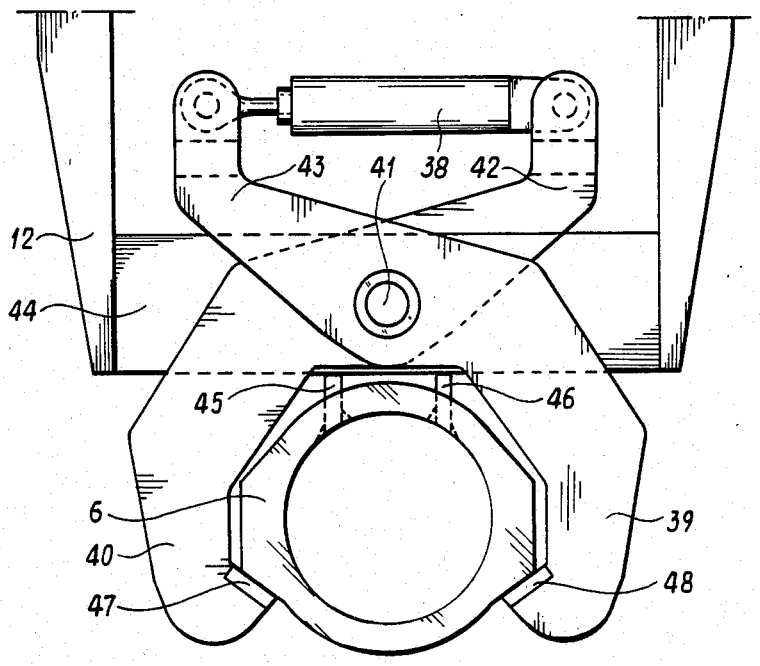
FIG. 3 is a side view of a clamp for gripping a suction head.

In FIG. 2 can be seen the upper face of the hydraulic cylinder 38 of the clamp shown in FIG. 3. This clamp has two double clamp arms 39 and 40, which pivot about a pin 41, and double arms 42, 43 between which the cylinder 38 is disposed. By means of the pin 41 the clamp 39, 40 is likewise fastened to a cross bar 44 of the arms 12 and 13 respectively.

The rapid-action coupling part 6 has backs 45, 46, by means of which the part 6 is pressed against the cross bar 44 when the inclined clamp faces 47, 48 of the clamp arms 39 and 40 grip the rapid-action coupling part.

The arms 12, 13 are mounted for rotation on the shaft 11, which in turn is non-rotatably fastened in the yoke 10. The cylinders 19 and 20 are supported by their ends for rotation in the arms 12 and 13.

With the device according to the invention it is possible to change a suction head within half an hour, which generally means that the change can for example be made during the journey from the dredging site to the the dumping ground.

Instead of the construction illustrated, which is preferred because of accessibility and space occupied, it is naturally also possible to construct a changing device in which the arms together with the suction heads clamped in them turn about a vertical axis.

However, FIG. 1 clearly shows that in the preferred embodiment the suction head which is not in operation has its working surface turned upwards, so that any repairs required to the working surface can be made from above and not, as is customary, from below. If the towing head has teeth, these can therefore be replaced from above.

It will also be clear that the changing of the suction head can be effected entirely automatically.

Where in the foregoing mention is made of a suction head, a trailing head for a towing hopper suction dredge is intended. The principle underlying the invention is however applicable to any type of suction head, including those provided with a driven or non-driven cutter.

We claim:

1. A hopper suction dredge having a deck and a suction pipe, hoisting means for moving said suction pipe inboard and outboard, said suction pipe having at its bottom end a replaceable part, means detachably securing said replaceable part to said bottom end, said detachable securing means comprising a rapid action coupling, and a device secured to said deck, said device having means thereon to grip a first said part while said part is still fastened to said suction pipe and second means to simultaneously hold a second, uncoupled replacement part and, after said rapid action coupling has been uncoupled, to move said first part over a predetermined path and simultaneously move said second part into position to replace said first part.

2. A hopper suction dredge as claimed in claim 1, in which at least one of said parts is a suction head.

3. A hopper suction dredge as claimed in claim 1, in which at least one of said parts is an accessory of a suction head.

4. A hopper suction dredge as claimed in claim 1, in which said device comprises a plurality of sets of arms mounted for conjoint rotation about a common horizontal axis.

5. A hopper suction dredge as claimed in claim 4, in which said axis passes through a yoke that carries said arms, and means mounting said yoke for vertical swinging movement about a horizontal axis fixed relative to the deck of the suction dredge and spaced from and parallel to the first-mentioned axis.

* * * * *